United States Patent [19]

Adkins

[11] Patent Number: 4,534,495

[45] Date of Patent: Aug. 13, 1985

[54] THIMBLE

[76] Inventor: Jean Adkins, 201 Hope Mills Rd., Fayetteville, N.C. 28304

[21] Appl. No.: 585,868

[22] Filed: Mar. 2, 1984

[51] Int. Cl.[3] ..... D05B 91/04

[52] U.S. Cl. ..... 223/101

[58] Field of Search ..... 223/101, 102, 104, 109 R

[56] References Cited

U.S. PATENT DOCUMENTS 640,853 1/1900 Arnold ..... 223/104 X 4,102,480 7/1978 O'Beirne-Ranelagh ..... 223/101

4,460,113 7/1984 Nicklous ..... 223/101

*Primary Examiner*—Werner H. Schroeder

*Assistant Examiner*—J. L. Kravitz

*Attorney, Agent, or Firm*—Berman, Aisenberg & Platt

[57] ABSTRACT

A hand-held thimble includes an elongate handle for being grasped by the palm and fingers of a sewer. A head extends outwardly from the handle and includes a face adapted to engage a sewing needle. The thimble is primarily useful in quilting and provides increased control over the needle.

11 Claims, 3 Drawing Figures

FIG 1
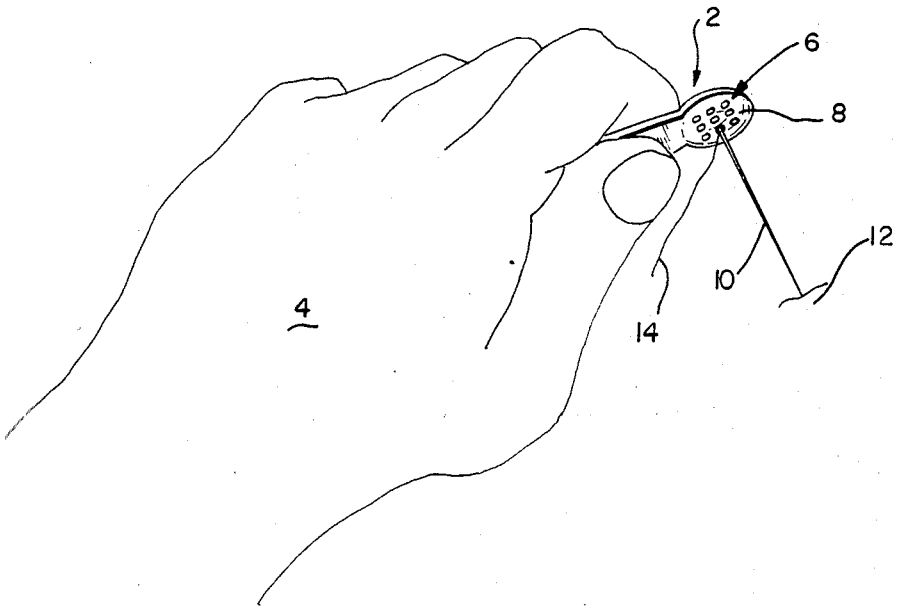
FIG 2
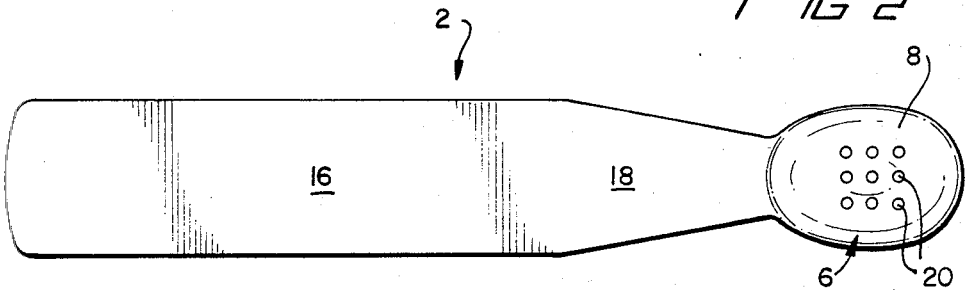
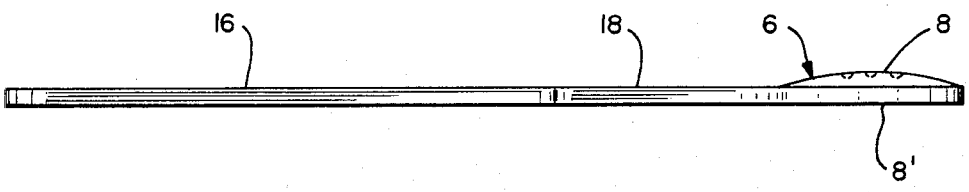
FIG 3

THIMBLE

TECHNICAL FIELD

This invention relates to the art of thimbles, particularly thimbles used in quilting.

BACKGROUND ART

The process of quilting involves the use of a somewhat small needle to pull thread through the quilt which is ordinarily held on the quilter's lap in a horizontal position. The needle is inserted into the material with one hand and is pushed through the material with the use of a thimble.

A known thimble is a cap-like object having a hollow portion for inserting the tip of the sewer's finger. The outer surface of the thimble is roughened to facilitate its securely engaging the head of a sewing needle. This thimble is quite inconvenient since it rubs against adjacent fingers which causes injury for a frequent sewer. Furthermore, a sewer must have a short fingernail on the finger to be used with the prior art thimble, otherwise the thimble will not fit properly on the end of the finger. Also, the prior thimble must be provided in various sizes to properly fit fingers of different sewers.

U.S. Pat. No. 1,082,542 (Manson) discloses a thimble for a leather worker. This thimble is attached to a leather strap which is secured to a user's hand so that the portion of the thimble which engages a needle is located in the palm of the hand. This allows the sewer to push the needle through very heavy material, such as leather, by engaging the thimble with the head of the needle and pushing. The Manson thimble is not useful for general sewing, which requires a high degree of control of the needle, since it is extremely difficult to push the needle through material in any direction except directly away from the worker.

SUMMARY OF THE INVENTION

The invention is a hand-held thimble which is easily grasped in the hand of a sewer so that the head of the thimble extends outwardly from the hand to engage the head of a needle. The preferred embodiment of the thimble has a relatively flat handle and a tapered portion adjacent to the head which allows it to be easily manipulated by the fingers and thumb of the sewer. In some instances, the thimble may be held between the palm and the fingers of the user while the thumb engages the material to be sewn, thus greatly simplifying the manipulation of the sewing, or quilting, needle.

In another method of use, the needle is held flat against the face of the thimble by the sewer's thumb. This is particularly useful when placing the first stitch. Also, by pressing the needle against the thimble, it may be used as a sort of vise to pull the needle out of material.

The thimble is preferably made of a sturdy material, such as metal or hard plastic, so the needle cannot punch through the thimble when it encounters thick material and so that the handle will not flex significantly when force is applied to it.

It is an object of this invention to provide a thimble which may be held in the hand of a user for use in sewing or quilting.

It is a further object of this invention to provide a thimble having an elongate handle and a head portion adapted to engage the head of a sewing or quilting needle.

It is another object of this invention to provide a hand-held thimble having an elongate handle and a narrow neck portion for facilitating manipulation of a sewing or quilting needle.

BRIEF DESCRIPTION OF THE DRAWINGS

FIG. 1 is a perspective view of the thimble of the invention held in the hand of a user and engaging the head of a needle.

FIG. 2 is a plan view of the thimble according to the invention.

FIG. 3 is a side view of the thimble according to the invention.

DETAILED DESCRIPTION OF THE DRAWINGS

With reference to FIG. 1, a hand-held thimble 2 is shown in an operative position being held by the left hand 4 of a quilter. The head 6 of the thimble has a face 8 which is shown engaging a needle 10. The needle is being urged into material 12 to thereby draw a thread 14 through the material.

FIGS. 2 and 3 show the preferred embodiment of the thimble 2. A handle 16 is preferably elongated to allow the hand of the sewer to easily grasp and manipulate the thimble. A neck 18 is a somewhat narrowed extension of the handle 16, and a head 6 is attached to an outer end of the neck 18. The head 6 includes a face 8 which is adapted to engage the head of a needle, such as the needle 10 shown in FIG. 1. The face 8 preferably has a plurality of dimples 20 having a diameter similar to a diameter of the head of a needle to be used with the thimble. Of course, it is possible to provide dimples of different sizes to facilitate engagement with a variety of needles. In the preferred embodiment, the head 6 has a face 8 on one side of the head and a face 8' (see FIG. 3) on an opposed side of the head. This allows the thimble to be used in any orientation, thus providing easier use.

The thimble of the invention is very easy to use since one need only grasp the thimble by the handle 16 and place the neck 18 between the thumb and forefinger. In this position, the thimble is easily oriented to allow the quilter to manipulate the needle 10 easily. The thimble 2 need only be made in one size to be used by all quilters.

While the face of the preferred embodiment has dimples 20, it should be understood and that configuration of face 8 may be varied to provide any means for engaging the head of the needle 10. For example, a series of grooves may be provided on the face 8 to engage the head of the needle, or face 8 may have a pattern different from that on face 8'. Furthermore, the face 8 may be flat or slightly convex as in FIG. 3.

Also, the shape of the handle may be varied even though the preferred embodiment employs a handle having a constant thickness and a neck portion of reduced width to facilitate manipulation of the thimble. The handle may be curved, and the thickness may be variable if so desired.

It will be appreciated that a novel thimble has been described wherein a handle allows the thimble to be grasped by the fingers and palm of a sewer, for example, a quilter, to facilitate manipulation of a needle. While the thimble finds primary utility for use in quilting, it will be appreciated by those of skill in the art that it may be used in other types of sewing.

Modifications within the scope of the appended claims will be apparent to those of ordinary skill in the art.

What is claimed is:

1. A thimble for use in sewing comprising an elongate handle which extends in a direction and is easily held in the hand of a quilter and a head attached to one end of said handle, said head having a broad face extending generally parallel to said direction and having means disposed on a substantial portion of said broad face for easily and securely engaging a needle without slipping such that said needle, when engaged by said face, extends transversely to said direction.

2. The thimble of claim 1 wherein said handle is generally flat and further comprising a neck connecting said one end to said head and tapering to be narrower adjacent said head.

3. The thimble of claim 2 wherein said handle has a substantially constant thickness.

4. The thimble of claim 3 wherein said face is convex.

5. The thimble of claim 4 wherein said head has two opposed faces, each configured to engage a needle.

6. The thimble of claim 1 wherein said face includes a plurality of dimples, each dimple having a diameter approximately equal to the diameter of a needle.

7. The thimble of claim 1 wherein said needle is a quilting needle.

8. A method of sewing comprising pushing a needle through material being sewn by grasping the handle of the thimble of claim 1 so that the head extends outwardly from a hand and engages said needle with the face of said thimble.

9. A thimble for use in sewing comprising an elongate handle easily held in the hand of a guilter and a head attached to one end of said handle, said head having a face configured to engage a needle without slipping, wherein said face includes a plurality of dimples, each dimple having a diameter approximately equal to the diameter of a needle.

10. A thimble for use in sewing comprising an elongate generally flat handle having a substantially constant thickness and which is easily held in the hand of a guilter; and a head attached to one end of said handle by a neck which tapers to be narrower adjacent said head, said head having two opposed faces each configured to engage a needle without slipping.

11. A thimble of claim 10 wherein one of said faces is convex.

* * * * *